US006705826B1

(12) United States Patent
Callens

(10) Patent No.: US 6,705,826 B1
(45) Date of Patent: Mar. 16, 2004

(54) LIFT TRUCK

(76) Inventor: Ludo Willy Florentina Callens, Heuvelstraat 72, B-2530 Boechout (BE)

( * ) Notice: Subject to any disclaimer, the term of this patent is extended or adjusted under 35 U.S.C. 154(b) by 0 days.

(21) Appl. No.: 09/926,668

(22) PCT Filed: May 29, 2000

(86) PCT No.: PCT/BE00/00057

§ 371 (c)(1),
(2), (4) Date: Nov. 30, 2001

(87) PCT Pub. No.: WO00/73198

PCT Pub. Date: Dec. 7, 2000

(30) Foreign Application Priority Data

Jun. 1, 1999 (BE) ..... 9900377

(51) Int. Cl.[7] ..... B66C 23/00
(52) U.S. Cl. ..... 414/686; 414/700
(58) Field of Search ..... 414/680, 685, 414/686, 699, 700, 713

(56) References Cited

U.S. PATENT DOCUMENTS 3,198,359 A * 8/1965 Lull ..... 414/713
4,791,549 A * 12/1988 Heiser et al. ..... 414/700

* cited by examiner

*Primary Examiner*—Donald W. Underwood
(74) *Attorney, Agent, or Firm*—Bacon & Thomas, PLLC

(57) ABSTRACT

The present invention concerns a lift truck comprising a mobile frame (1), a tiltable boom (3) provided upon it and tilting means (7) for tilting said boom (3), whereby the boom (3) is fixed to the frame (1) in a tilting manner by means of a support (5) which can be moved in relation to the frame (1) in the longitudinal direction of this frame (1), and whereby the lift truck contains displacement means (8) for moving this support (5) which are coupled to the tilting means (7) for the boom (3), such that these tilting means (7) and the displacement means (8) simultaneously tilt the boom (3) together and move the support (5) of the boom (3) in such a manner that the front end of the boom (3) follows a path which is practically perpendicular to the above-mentioned longitudinal direction of the frame (1).

13 Claims, 8 Drawing Sheets

LIFT TRUCK

BACKGROUND OF THE INVENTION

The present invention concerns a lift truck comprising a mobile frame, a tiltable boom provided upon it and tilting means for tilting said boom.

In particular, the invention concerns a lift truck for moving and stacking containers, pallets, coils, other goods and heavy objects.

Most lift trucks are equipped with a double or multiple extending mast, mounted at the front and in which a fork carriage can move vertically.

These lift trucks offer the advantage that the fork carriage moves upright and does not carry out a movement as such during this movement, but when they have a large lift height, they necessarily have a large building height, especially due to the high mast. The total height becomes even larger when these lift trucks are transported on a lorry.

Said large building height and thus the headroom can be disadvantageous under a number of circumstances, for example when driving through relatively low passages on factory sites or in warehouses, under bridges or in tunnels on the road or on board of ships.

For a certain lift height, however, it is possible to reduce the building height by increasing the number of parts of the mast, but this makes the construction much more complex, whereas the lift truck becomes more vulnerable and requires more maintenance. The larger number of mast parts also restricts the view of the driver to a large extent.

The mast being situated at the front, i.e. before the front wheels, is not only disadvantageous to the visibility, but also has for a result that the weight of the loads being lifted applies before said front wheels, so that heavy counterweights are required at the back in order to prevent the lift truck from tipping over.

Lift trucks with a tiltable boom avoid a large number of the above-mentioned disadvantages.

A normal boom which pivots around an axle situated in a fixed place, is disadvantageous in that the end of the boom, and as a consequence the fork carriage, carries out a circular movement around said axle.

As the tilting axle is situated at a distance above the ground, whereas the boom can reach the ground with its far end, the far end of the boom will move forward during part of this circular movement. In some cases, if the lift truck is not backed in due time, the lifted load will collide with other objects, which may result in damages.

Also when a load is picked up or placed at a large height, the lift truck, as it is situated more to the back, can be driven too far forward and can collide with loads or such situated at a lower level.

Moreover, the centre of gravity of the whole varies during the lifting or lowering, which may have a negative influence on the stability of the lift truck.

The load may even be situated above the driver's cabin then, which is quite dangerous.

The far end of the boom can follow a more or less straight course, however, when the boom is telescopic and can slide in and out.

A telescopic boom with a device for sliding in and out is considerably more expensive, however, than one which cannot extend.

Moreover, in case of heavy loads, whereby the telescopic boom must be made relatively heavy, the lower tubular part of the boom which is connected to the frame by means of the hinge pin, must have large dimensions, among others in the vertical height. As this part is situated next to the driver's cabin, the lateral visibility of the driver will be reduced to zero as a result thereof, and special expensive and vulnerable electronic means such as cameras must be used to repair this visibility.

EP-A-0.630.779, discloses a lift truck with a boom the rear end of which is however fixed to the frame by means of a support which can be moved in relation to the frame in the longitudinal direction of said frame. The boom is pivoted by means of telescopic hydraulic cylinders.

An arm is fixed with one end by a pivot to the boom and with another and by a pivot to a stationary support fixedly mounted on the frame in such way that when the cylinders pivots the boom, the foremost end of the boom follows a vertical path, while the movable support of the rear end is moved.

Due to the arm and the stationary support, this lift truck is relatively heavy and expensive. Moreover, as the hydraulic cylinders have not only to tilt the boom, but indirectly also to move the movable support, so that these cylinders have to be relatively heavy and the lift truck can in practice not lift very heavy loads.

SUMMARY OF THE INVENTION

The invention aims a lift truck with a tiltable but not telescopic boom which remedies the above-mentioned disadvantages and which allows its top end to follow an almost vertical path when being tilted and can lift relatively heavy loads.

This aim is reached according to the invention in a lift truck wherein the boom is not fixed directly to the frame, but by means of a support which can be moved in relation to the frame between a rear position and a front position, preferably in the longitudinal direction of said frame, whereby the lift truck comprises a displacement device or means to move said support which are coupled to the tilting device or means, such that, while the tilting means tilt the boom, the displacement means simultaneously move the support of the boom in such a manner that the front end of the boom follows a path which is almost perpendicular in relation to said longitudinal direction of the frame.

As the boom does not have to be telescopic, it may consist of a framework, as a result of which the visibility for the driver is much increased, and the construction can be made lighter.

The support may consist of a carrier which can slide over a guide which is fixed onto the frame.

The tilting means for the boom may contain one or several hydraulic or pneumatic cylinders, as well as one or several electric jacks.

The displacement means for moving the support of the boom in relation to the frame may also contain one or several hydraulic, pneumatic cylinders or electric jacks.

The displacement means for the support and the tilting means for the boom can be coupled by a mechanical coupling containing a follower which is fixed to the boom and which follows a template provided on the frame.

The displacement means and the tilting means may be coupled to one another by means of a coupling containing means for measuring the angle of inclination of the boom or the position of the support, and control means for controlling the displacement means, the tilting means respectively, as a function of the measurement.

The coupling may hereby contain a sensor for measuring the angle of inclination of the boom, as well as a linear sensor for measuring the position of the support in relation to the frame, and an electronic control which, according to a connection which has been put in beforehand, required between the angle of inclination and the position of the support in order to obtain the above-mentioned almost vertical movement of the front end of the boom, as a function of the measured angle of the boom or the measured position of the support, control the displacement means for the support, the tilting means for the boom, respectively.

The angle of inclination can be measured both directly and indirectly, for example by measuring the variation in length of the cylinder in order to tilt the boom, since there is a fixed relation between both. Also the position of the support in relation to the frame can be measured indirectly by measuring the variation in length of the cylinder in order to move the support.

Another possibility consists in that the displacement means and the tilting means are coupled to one another by a coupling containing a template and a follower, whereby the template is fixed in relation to the frame and imposes a specific path onto the follower, and whereby the coupling contains a detection device or means to detect a change in the vertical distance between the follower and a point which is fixed to the boom at a distance from the geometrical tilting axis, in order to control, as a function thereof, the displacement means for the support, so that the above-mentioned change in the vertical distance is compensated.

BRIEF DESCRIPTION OF THE DRAWINGS

In order to better explain the characteristics of a lift truck according to the invention, the following preferred embodiments are described as an example only without being limitative in any way, with reference to the accompanying drawings, in which.

DETAILED DESCRIPTION OF THE INVENTION

Figure 1:
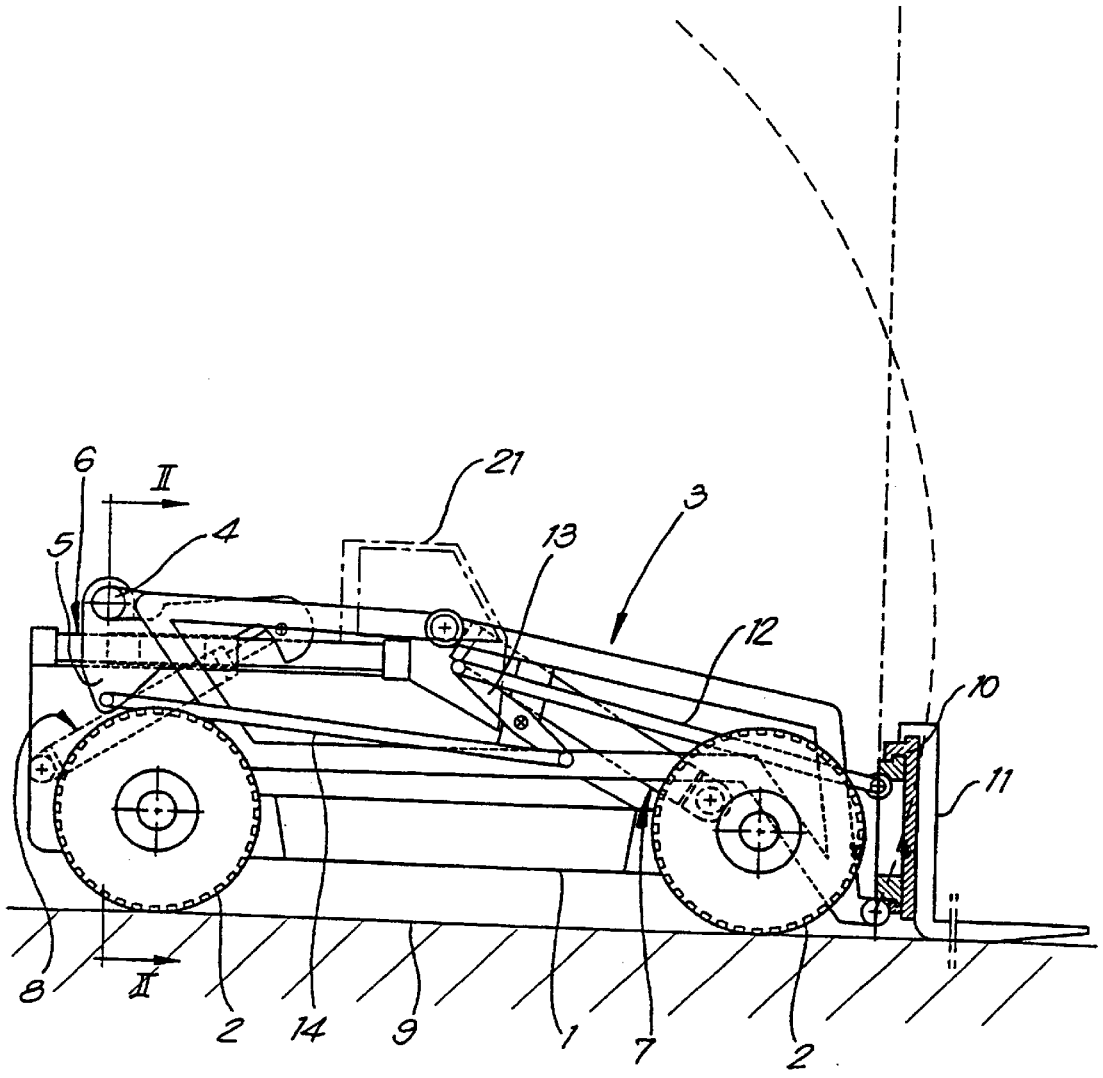
FIG. 1 schematically represents a side view of a lift truck according to the invention, whereby the boom stands in its lowest position.
Figure 2:
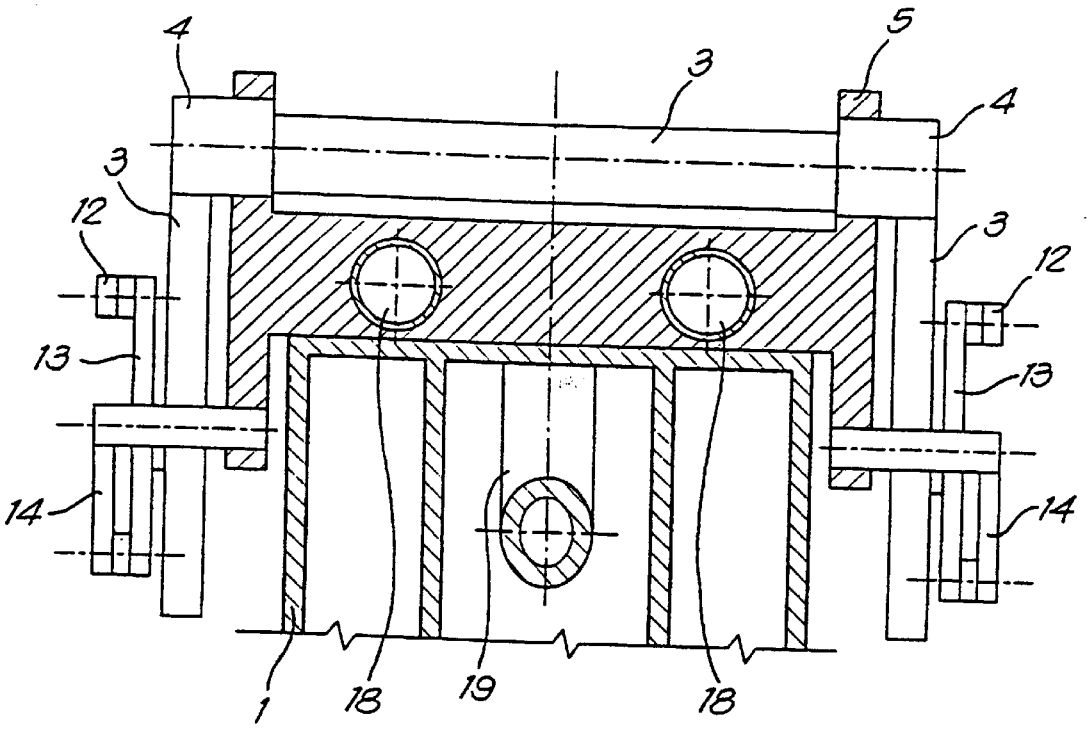
FIG. 2 represents a section according to line II—II in FIG. 1.

The lift truck represented in FIGS. 1 to 4 mainly comprises a mobile frame 1 which is carried by wheels 2 and a non-extendible boom 3 which is fixed in a tilting manner around a horizontal tilting axle 4 onto a support 5 which can be moved over a guide 6 which is fixed on the frame 1 and which is directed in the longitudinal direction, i.e. from the back to the front, whereas tilting device or means 7 are provided to tilt the boom 3, and displacement device or means 8 to slide the support 5 over the guide.

The frame 1 can be self-propelled and may contain to this end an engine which is mounted in the frame 1 and which is not represented in the FIGS. 1 to 4.

The boom 3 consists of a framework.

This boom 3 has a dip, so that, when its rear part is lying down practically horizontally on the frame 1, the front part is directed slantingly downward, and its front end will practically lie on the bottom 9 as is represented in FIG. 1.

At the front end of the lifting point of this boom 3, a fork carriage 10 is pivot-mounted with its lower side. Onto this fork carriage 10 can be suspended forks 11.

It is clear that also other parts can be fixed to the fork carriage 10, such as a coilboom for carrying coils. Also the fork carriage 10 is detachable and can be replaced by other carriages.

In order to maintain the fork carriage 10 in a vertical position when tilting the boom 3, its top side is pivot-mounted to a rod 12 which is pivot-mounted to an end of a longitudinal reversing plate 13.

This reversing plate 13 is pivot-mounted in its middle to the framework of the boom 3, and it is pivot-mounted with its other end to a second rod 14 which is also pivot-mounted to the support 5, at a distance from the tilting axle 4.

Other mechanisms can be provided to keep the fork carriage 10 horizontal, such as for example a hydraulic mechanism or an electronic/hydraulic mechanism.

This makes it possible to nevertheless tilt the fork carriage 10 around its hinged attachment on the boom 3 if required.

Figure 3:
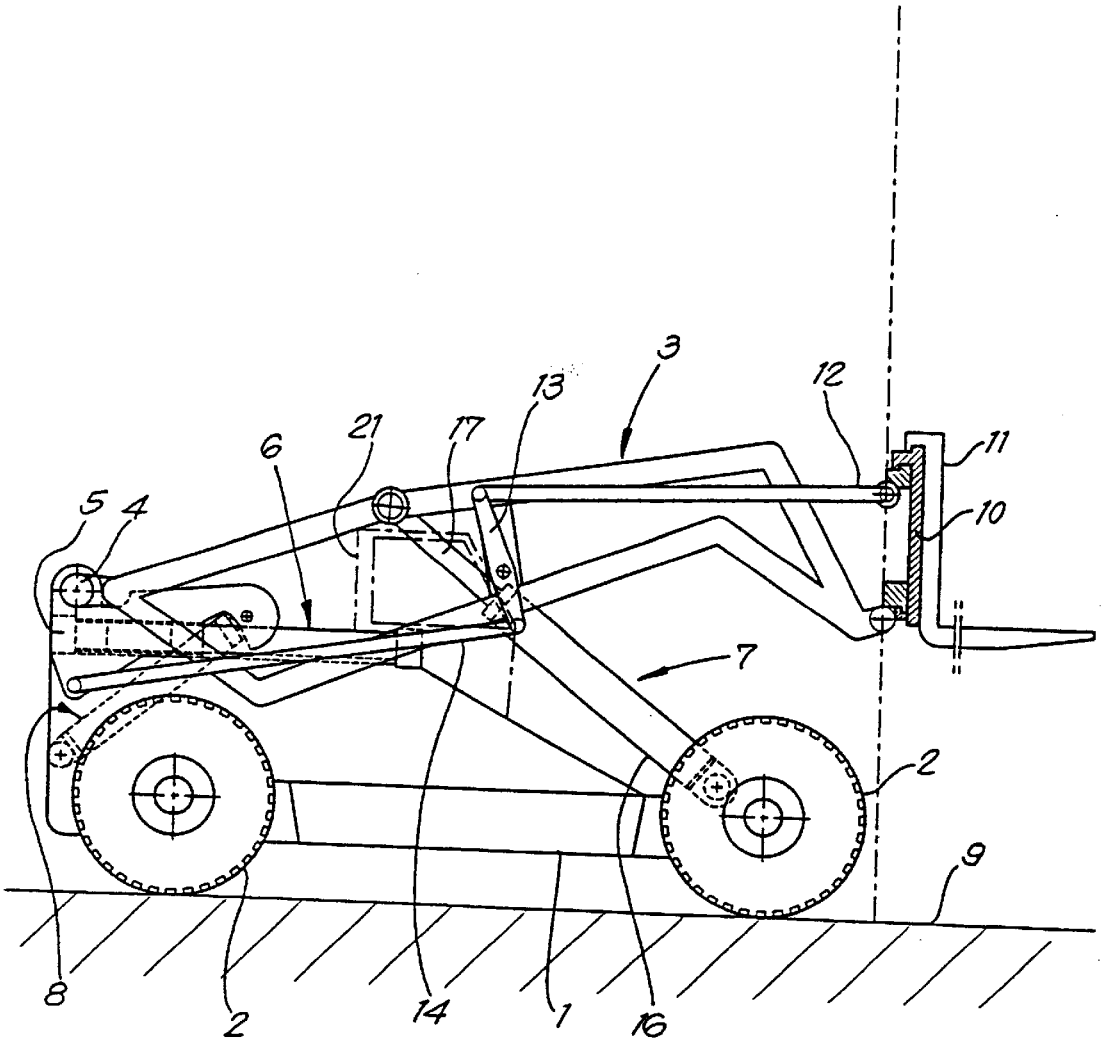
FIG. 3 represents a side view similar to that in FIG. 1, whereby the boom stands in a higher position.
Figure 4:
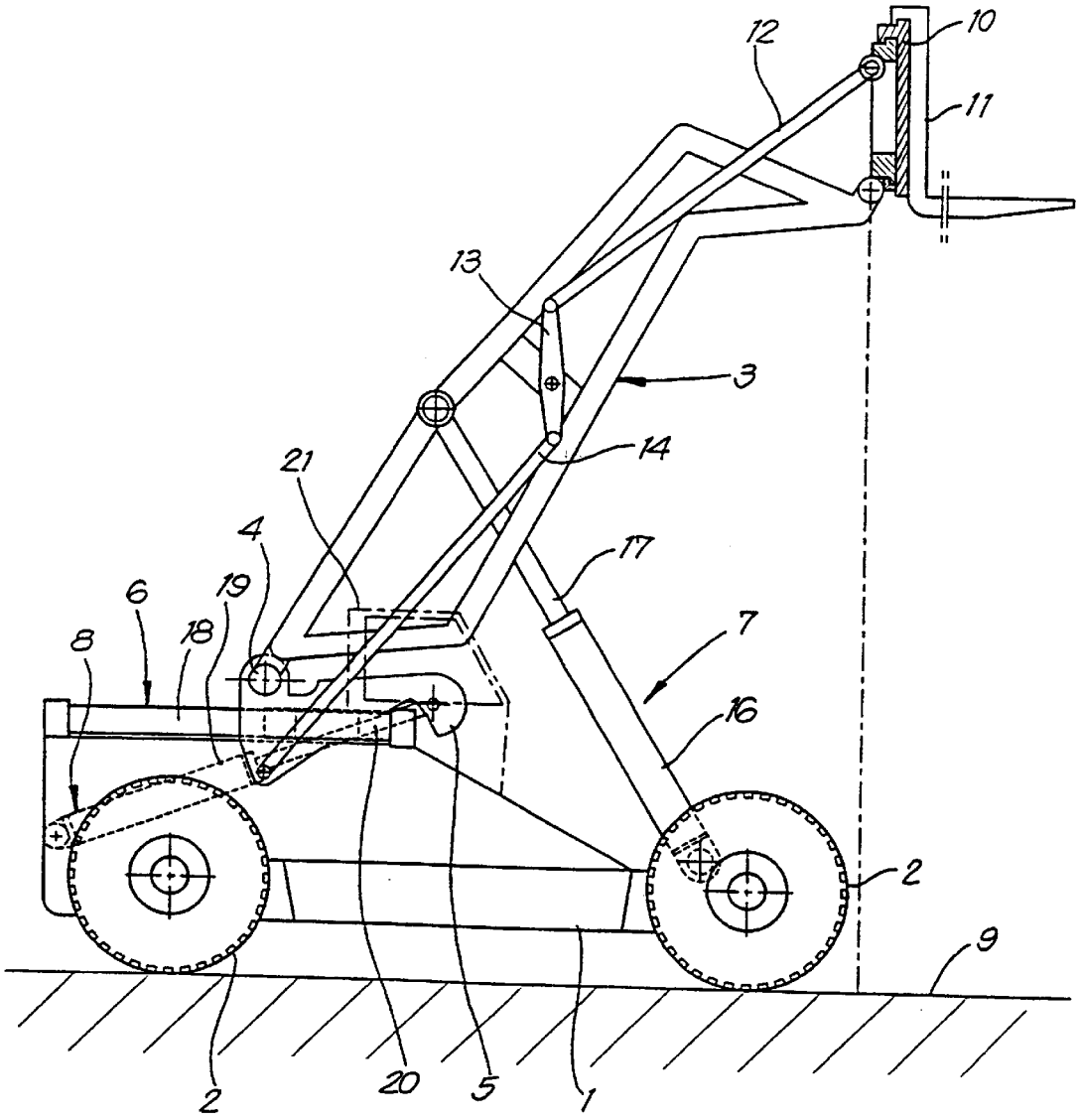
FIG. 4 represents a side view similar to that in FIG. 3, whereby the boom stands in its highest position.
Figure 5:
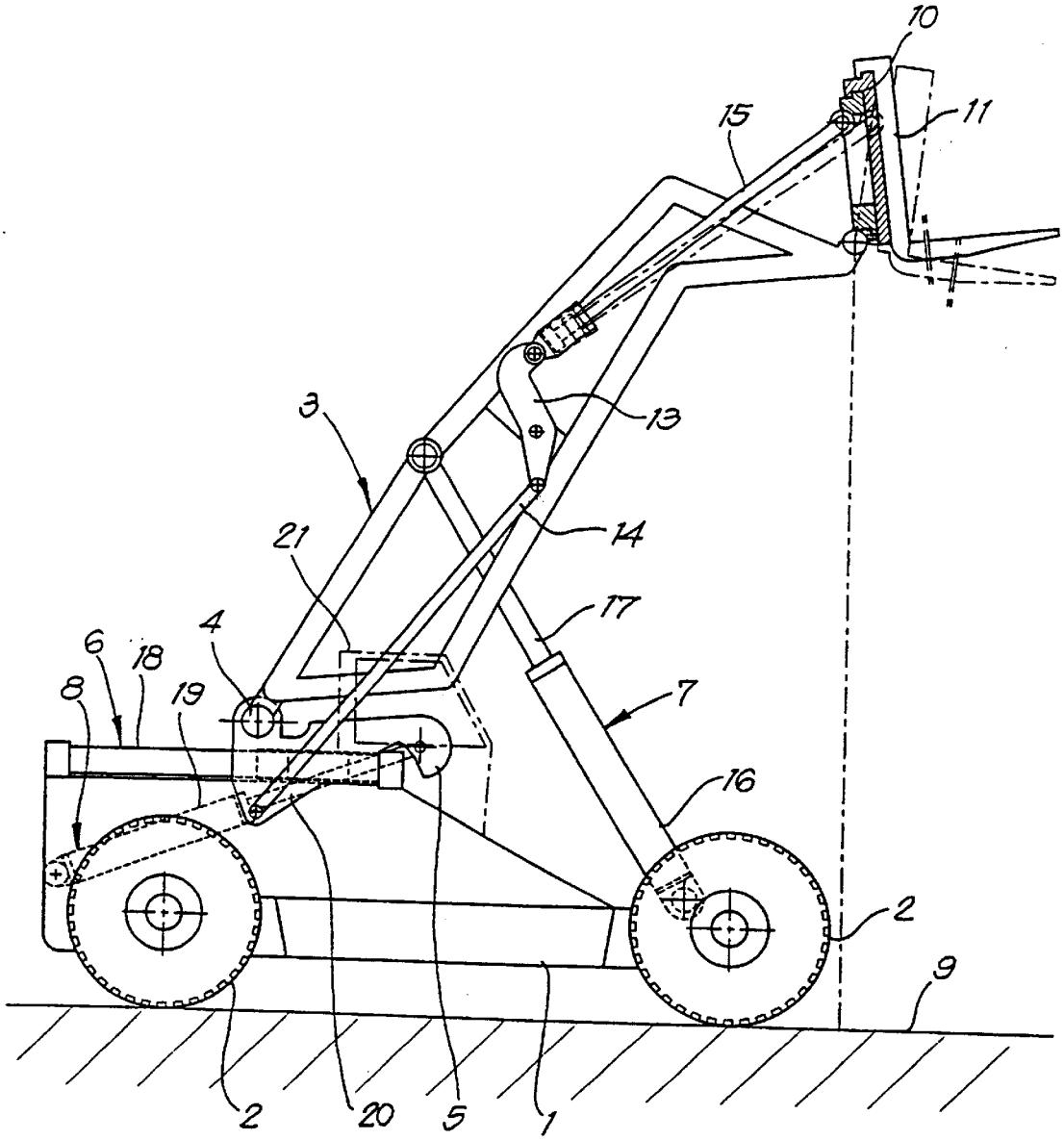
FIG. 5 represents a side view analogous to that in FIG. 4, but with reference to another embodiment of the lift truck according to the invention.

According to a variant, this can also be realised in a simple manner by replacing the rod 12 in the embodiment according to FIGS. 1 to 4 by a hydraulic cylinder 15 as is represented in FIG. 5.

In the given examples according to FIGS. 1 to 4 and according to FIG. 5, the tilting means 7 for tilting the boom 3 consist of a hydraulic cylinder. This cylinder contains a cylinder 16 which is pivot-mounted to the frame 1 at the front, and a piston rod 17 which is pivot-mounted to the boom 3 near a dip.

Instead of one hydraulic cylinder, the tilting means 7 may also contain two of these.

The support 5 forms a carriage which can be moved over two horizontal rods 18 extending in the longitudinal direction of the frame 1, i.e. from the rear to the front, and which are fixed to parts of the frame 1 with both their ends.

According to a variant, this support 5 may be a trolley which can be moved in two laterally erected horizontal profile beams by means of rollers.

The displacement means 8 for this support 5, just as the tilting means 7, consist of a hydraulic cylinder whose cylinder 19 is pivot-mounted to the frame 1 behind the rear wheels 2, and the piston rod 20 is pivot-mounted to the front of the support 5, practically at the height of the tilting axle 4 which is situated at the back of the support.

Both hydraulic cylinders are provided in a hydraulic circuit with a control. This circuit, which feeds the hydraulic cylinders, and the accompanying control, are not represented in FIGS. 1 to 5 for clarity's sake.

Figure 6:
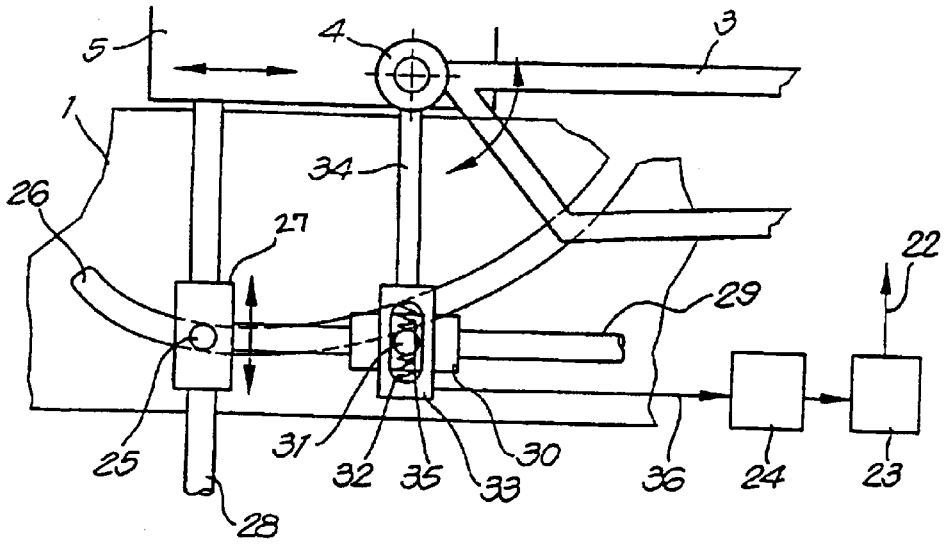
FIG. 6 schematically represents the control of the means for tilting and displacing the boom.

FIG. 6 partly represents the control and, in so far as is necessary to illustrate the invention, also the hydraulic circuit.

The hydraulic cylinder forming the tilting means 7 for tilting the boom 3, is fed via electrically controlled valves which are controlled from the driver's cabin 21 which is erected next to the boom 3 on the frame 1.

The hydraulic cylinder forming the displacement means 8 for moving the support 5 is also fed via hydraulic pipes 22 and valves which are built-in in a valve block 23, but which are automatically controlled in an electric manner by a control device 24 as a function of the position of the boom 3, such that, when the boom 3 tilts, its front end will move almost vertically and thus perpendicular to the longitudinal direction of the frame 1, according to a path which is represented by means of a chain line in FIGS. 1, 3, 4 and 5. Without the support 5 being displaced, the front end of the boom 3 would follow a circular path as is represented by means of a dashed line in FIG. 1.

This implies that there is a coupling between the tilting means 7 and the displacement means 8, which coupling, as is represented in detail in FIG. 6, contains a follower 25 which is forced to follow a template 26.

This follower 25 is a finger which is fixed on a sleeve 27 which can be moved over a vertical rod 28 which is fixed onto the support 5, whereas the template 26 is a groove with a specific pattern in which the above-mentioned finger sticks and which is provided in a horizontal plate fixed on the frame 1.

On the sleeve 27 is fixed a horizontal rod 29 directed in the longitudinal direction of the frame 1, over which can slide a second sleeve 30 and upon which stands a pin 31.

This pin 31 sticks in a groove 32 which is provided in the wall of a longitudinal box 33 which is fixed in relation to the boom 3, and which, in the given example, is carried by the end of an arm 34 which is fixed to the tilting axle 4. This arm 34 could be part of the actual framework of the boom 3, in part or as a whole.

Both the groove 32 and the box 33 are directed in the longitudinal direction of the arm 34, i.e. radially in relation to the tilting axle 4.

The pin 31 is situated in the box 33 between two springs 35 which push this pin 31 towards the middle of the groove 32, and to the pin 31 is connected the feeler of a linear potentiometer which is erected in the box 33 and which is part of an electric circuit 36 to which the control device 24 is connected. These elements form a part of a detection device or means of the invention.

The working of the above-described lift truck is as follows:

FIG. 1 represents the lift truck with the boom 3 tilted maximally downward and with the forks 11 on the bottom 9.

In this position, the support 5 is situated far to the back, not in its rearmost position but at a distance therefrom.

When the driver of the lift truck, by controlling the valves in the circuit of the hydraulic cylinder of the tilting means 7, extends this cylinder and thus makes the boom 3 tilt upwards, the displacement means 8 will first shift the support 5 backward over the guide 6, thanks to the coupling with these means and in a manner which will be described hereafter, until the boom 3 assumes the position as represented in FIG. 3, such that the front end of the boom 3 and thus the fork carriage 10 move vertically.

When the boom 3 is tilted further up into its top position, as represented in FIG. 4, the support S, also thanks to the above-mentioned coupling, will then be shifted from its rearmost position to the front by the displacement means 8, also in such a way that the front end of the boom 3 always moves vertically.

When the boom 3 is tilted down, the opposite happens.

When the boom 3 is tilted, the arm 34 rotates along. The box 33 thus follows an arc around the geometrical tilting axis, so that the pin 31 is shifted in a linear manner over the rod 29 together with the sleeve 30 as a result of the horizontal component of the displacement of the box 33 on the one hand, and is shifted in the groove 32 as a result of the vertical component of the displacement of the box 33 on the other hand, unless the pin 31 is also moved correspondingly.

As soon as the pin 31 diverges from the middle of the groove 32, the feeler of the potentiometer in the box 33 is moved, and an alternating current is sent to the control device 24. As a result of this electric signal, the control device 24 will control the valves of the valve block 23, such that the cylinder of the displacement means 8 is slid in or extended, depending on said deviation.

As a result of the latter, the support 5 is thus moved horizontally, and the whole consisting of the rods 28 and 29, including the follower 25, is consequently also moved horizontally.

During this displacement, the follower 25 is obliged to follow the stationary template 26, which implies that the sleeve 27 and the rod 29, including the pin 31, are moved in the vertical direction, so that the pin 31 can be placed back in the middle of the groove 32.

Each time the distance between the follower 25 and the middle of the groove 32 changes, as seen in the vertical direction, this diversion is compensated by a displacement of the support 5, which causes a vertical displacement of the follower 25 via the template 26.

When the rotation of the boom 3 stops, the springs 35 make sure that the pin 31 is pushed to the middle of the groove 32, as a result of which the displacement means 8 and thus the support 5 stop on exactly the right place for the top of the beam to be situated on the above-mentioned vertical path.

Said template 26 is selected such that this connection between the horizontal shift of the support 5 and the position of the middle of the groove 32, which coincides with the angle of inclination of the boom 3, results in the above-mentioned vertical displacement of the boom end.

Since there is a fixed connection between the displacement of the support 5 and the tilting of the boom 3, the control can be carried out the other way round according to a variant, which implies that the coupling controls the tilting means 7 for the boom 3, whereas the driver of the lift truck controls the displacement means 8 for the support 5 directly.

Figure 7:
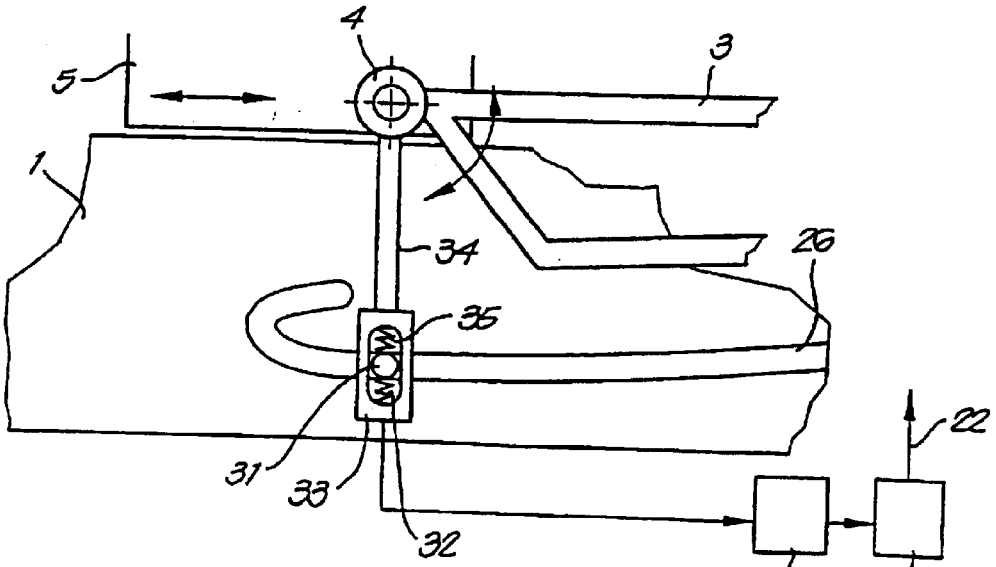
FIG. 7 schematically represents the control for the boom, analogous to FIG. 6, but with reference to another embodiment of this control.

According to another embodiment, shown in FIG. 7, the follower 25 consists of the pin 31, and it is thus the pen 31 which follows the template 26.

This pen 31 sticks in the groove forming the template 26 and is further not fixed to anything. The rods 28 and 29, as well as the sleeves 27 and 30, have been omitted.

The vertical distance between the follower 25, which in this case also is the pin 31, and the middle of the groove 32 thus must be zero.

The working is as described above. Each time the boom 3 tilts, the box 33 will pull along the pin 31 in the horizontal direction. As this pin 31 follows the template 26, this pen 31 will also move more or less in the vertical direction. As soon as the pin 31 diverges from the middle of the groove 32, the feeler of the potentiometer will be moved, and thus the displacement means 8 will be activated, as a result of which the support 5 is moved until the pin 31 is situated in the middle of the groove 32 again.

In order to make sure that the pin 31 not only follows the template 26, but is also situated in the middle of the groove 32, the support 5 must move. The template 26 is selected such that, due to this imposed displacement of the support 5, the front end of the boom 3 moves vertically up and down.

As in the beginning of the upward tilting of the boom the displacement means 8 will first shift the support 5 backward over the guide 6 and only thereafter forward, the template 26 in the embodiment of FIG. 7 shows a relatively sharply bent portion, where a small movement of the pen 31 may result in a great vertical movement of it.

Figure 8:
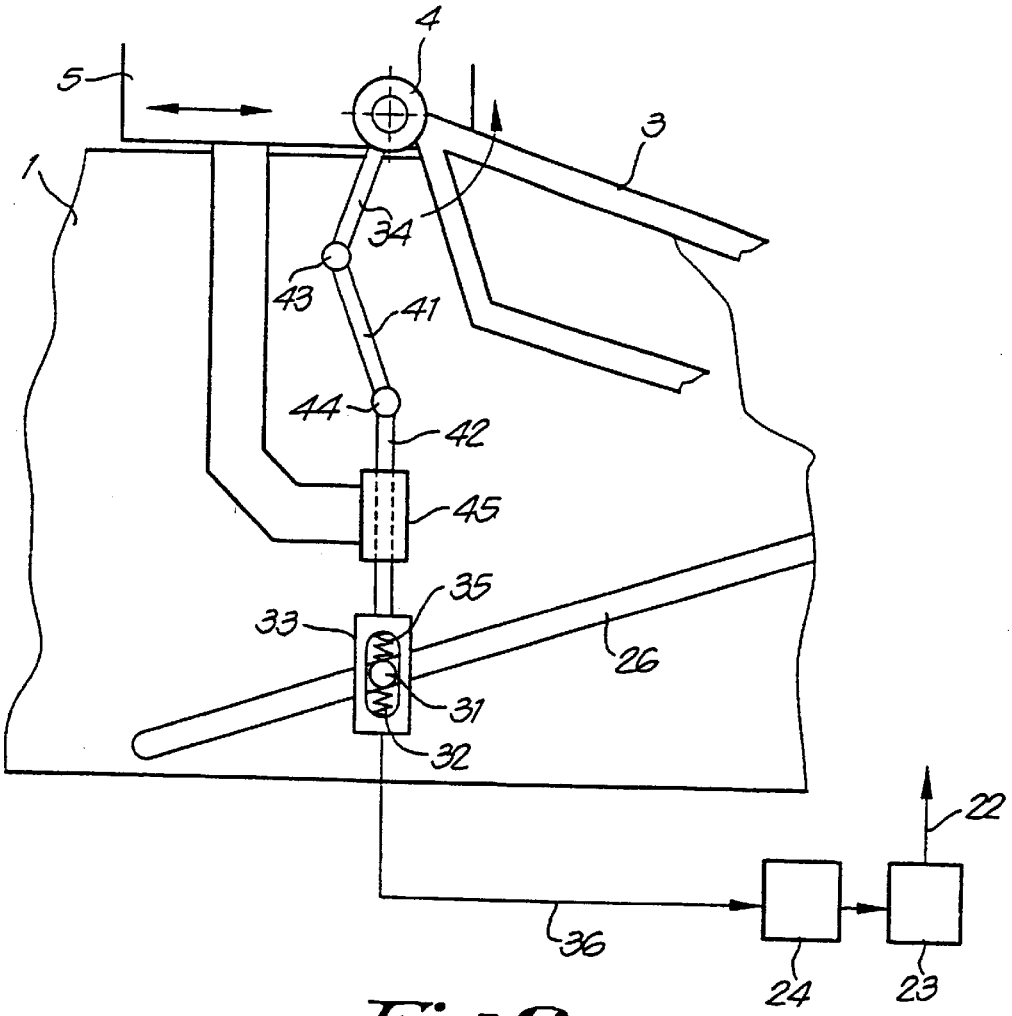
FIG. 8 schematically represents the control for the boom, analogous to FIGS. 6 and 7, but with reference to yet another embodiment of this control.

A bent template 26 may be avoided according to the embodiment shown in FIG. 8.

This embodiment differs from the embodiment of FIG. 7 essentially in that the arm 34 is not directly fixed to the box 33 but by the intermediary of a second arm 41 and a third arm 42.

The second arm 41 is connected by a pivot 43 to the arm 34 and by means of a pivot 44 to the arm 42, while the arm 42 is guided in a guide 45 which is supported by the support 5 and is situated underneath the rotation axis of the boom 3.

The template 26 is practically linear.

The working is as described with respect to the embodiment of FIG. 7.

In FIG. 8, the boom 3 is shown in its lowermost position.

When the boom 3 is pivoted upwardly, as shown by the arrow, the arm 34 pivots firstly to its vertical position. The arm 41 is also pivoted to its vertical position and it is clear that when both arms 34 and 41 are vertical, the box 33 is in its lowermost position.

During this first movement of the arm, the support 5 will move backwards. It will change movement as soon as the arm 34 pivots in the sense of the arrow beyond its vertical position.

In the preceding embodiments, the potentiometer inside the box 33 can be replaced by two micro-switches or even by a hydraulic or pneumatic relay valve or by control valves in a hydraulic circuit under low pressure, which then controls the above-mentioned hydraulic circuit via the control device 24.

Figure 9:
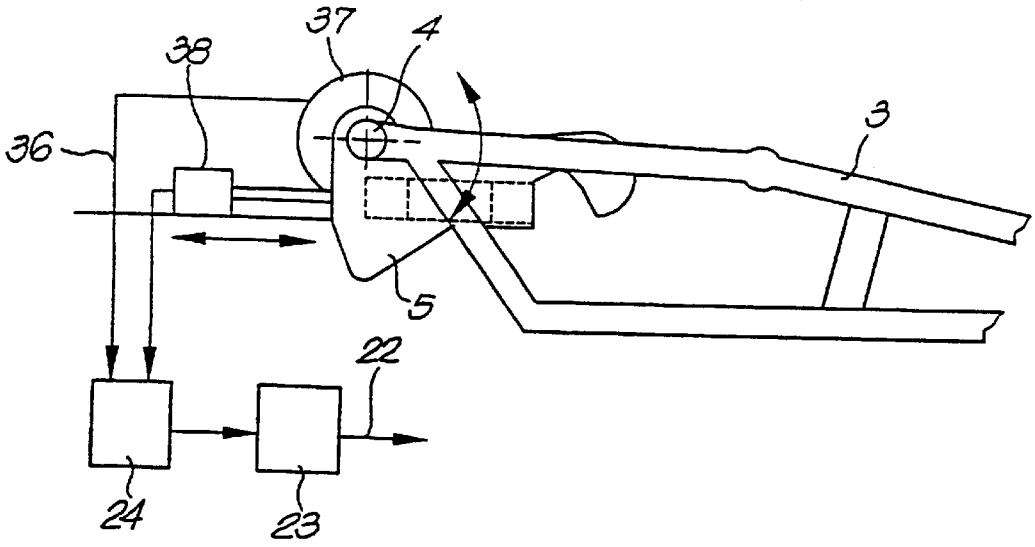
FIG. 9 schematically represents the control for the boom, analogous to FIGS. 6 to 8, but with reference to yet another embodiment of this control.

According to yet another embodiment, the hydraulic cylinders are entirely electrically controlled, as is represented in FIG. 9.

In this case, the template is replaced by an equation which determines the change of place of the support 5 as a function of the angle of the boom 3 so as to obtain the above-mentioned vertical movement of the boom top.

This equation is programmed in an arithmetic unit, for example a PLC control which is part of the control device 24 and which receives data from an angle sensor 37 provided on the boom 3 and from a linear sensor 38 erected along the guide 6 on the frame 1, which detects the position of the support 5. On the basis of the measurement of the angle sensor 37, the control device 24 makes sure that the displacement means 8 are adjusted, so that the measurement of the linear sensor 38 makes sure that the above-mentioned equation is correct.

Instead of measuring the angle of inclination directly, it is possible to measure the variation in length of the cylinder for making the boom 3 tilt, since there is a fixed relation between both; just the same, instead of measuring the position of the support 5 directly, it is also possible to measure the variation in length of the cylinder for moving the support 5.

It is clear that the cylinder forming the tilting means 7 for tilting the boom 3 and/or the cylinder forming the displacement means 8 for moving the support 5, can also be pneumatic instead of hydraulic, or can be replaced by an electric jack.

According to a particular embodiment, it is even possible that the coupling between the tilting of the boom 3 and the displacement of the support 5 is carried out entirely automatically, so that the coupling and the displacement means 8 for moving the support 5 coincide.

Figure 10:
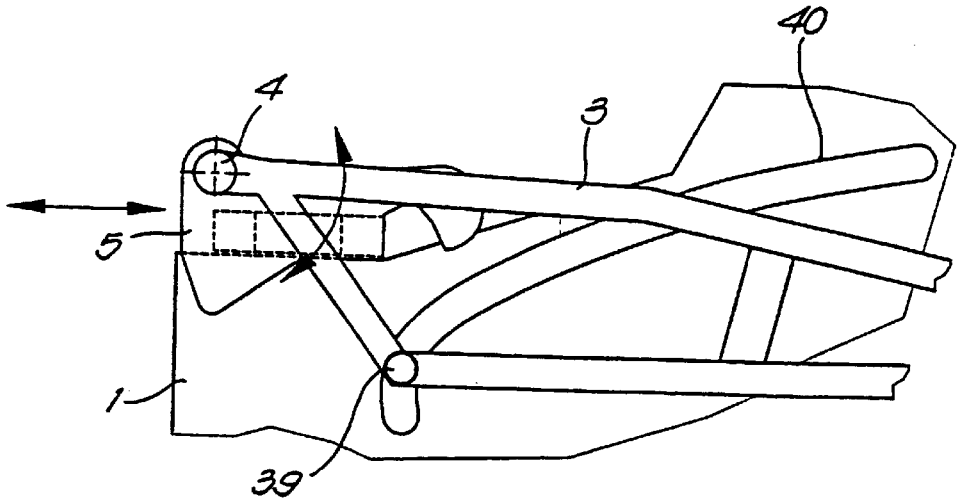
FIG. 10 represents the control of the means for tilting and displacing the boom, analogous to FIGS. 6 to 9, but with reference to another embodiment, both of this control and of the means for tilting and displacing the boom.

Such an embodiment is schematically represented in FIG. 10.

At a distance from the tilting axle 4, on one or both sides of the boom 3, for example in an angular point of the framework, is fixed a follower 39, for example in the shape of a horizontal roller, following a template 40 which is fixed on the frame 1. This template 40 is similar to the above-mentioned template 26, but it has a larger scale, and it also consists for example of a groove in a plate.

This template 40 is such that, when the boom 3 tilts and the follower 39 is consequently forced to follow the template 40, this follower 39 will push away the boom 3 and thus the support 5 in relation to the frame 1, to such an extent that the top of the boom 3 moves vertically.

Since the force is transmitted by the follower 39 or followers 39, this embodiment is only possible for a lift truck in case of relatively small loads.

In all the embodiments described above is automatically obtained that, when the non-extendible boom 3 is tilted, its front end is vertically moved. As the boom 3 consists of a framework, the visibility of the driver is not obstructed much by the boom.

What is claimed is:

1. A lift truck comprising:

a mobile frame;

a tiltable boom provided upon said frame and fixed thereto in a tilting manner by means of a support movable in relation to the frame between a rear position and a front position;

a tilting device arranged to tilt said boom; and a displacement device arranged to move the support and coupled to the tilting device for the boom, such that while the tilting device tilts the boom about a geometrical tilting axis, the displacement device simultaneously moves the support of the boom in such a manner that the front end of the boom follows a path which is practically perpendicular to the above-mentioned longitudinal direction of the frame; and wherein the displacement device and the tilting device are coupled to one another by a coupling containing a template and a follower, the template being fixed in relation to the frame and defining a specific path on for the follower, the coupling having a detection device arranged to detect a change in the vertical distance between the follower and a point which is fixed to the boom at a distance from the geometrical tilting axis, the distance of which can possibly be zero in order to control, as a function thereof, the displacement device, such that the above-mentioned change in the vertical distance is compensated.

2. The lift truck according to claim 1, wherein the support is movable in the longitudinal direction of this frame.

3. The lift truck according to claim 1, wherein the boom comprises a framework.

4. The lift truck according to claim 1, wherein the support comprises a carriage which can slide over a guide which is fixed onto the frame or a trolley which can be moved over a guide which is fixed onto the frame.

5. The lift truck according to claim 1, wherein the tilting device for the boom includes at least one hydraulic or pneumatic cylinder or electric jack.

6. The lift truck according to claim 1, wherein the displacement device for the support includes at least one hydraulic, pneumatic cylinder or electric jack.

7. The lift truck according to claim 1, wherein the detection device includes an element situated at a distance from the geometrical tilting axis and provided with a groove in which sticks the follower or a pin fixed in relation to the follower in the vertical direction, and arranged to shift in the horizontal direction, the point situated at a fixed distance from the tilting axle, is a point of the above-mentioned element.

8. The lift truck according to claim 7, wherein said element contains a box in which is situated at least one control element coupled to the control device, the point situated at a fixed distance from the tilting axle is a point of the box corresponding to the position of the control element to a neutral position thereof.

9. The lift truck according to claim 8, wherein the said control element is a potentiometer having a feeler connected to the follower or the pin, the potentiometer is connected to the control device in an electric circuit controlling electrically controlled valves of the hydraulic or pneumatic displacement means or an electric motor, the point situated at a fixed distance from the tilting axle is a point of the box corresponding to the position of the pin to a neutral position of the potentiometer.

10. The lift truck according to claim 8, wherein the box containing the control element is connected to an arm which is vertically moveable with respect to the support and is connected by a pivot to one end of another arm connected by a pivot to a point fixed to the boom at a distance from its rotation axis, the last mentioned pivot being situated rearward with respect to the pivoting axis when the boom is in a lowermost position.

11. The lift truck according to claim 1, wherein the follower is arranged to move freely in relation to the support and the frame, and cooperate directly with the template that contains a groove in a plate, the detection device is arranged to detect the vertical distance in the vertical direction of the follower in relation to a point fixed in relation to the boom.

12. The lift truck according to claim 1, wherein the follower is provided on the support for the boom and arranged to move in the vertical direction, and such that it is fixed in the vertical direction in relation to the pen which can be shifted in the horizontal direction in relation to the follower.

13. The lift truck according to claim 12, wherein the follower is provided on a sleeve arranged to slide over a vertical rod fixed to the support, the pen fixed on a second sleeve arranged to slide over a horizontal rod fixed to the first sleeve.

* * * * *